US008424928B2

(12) United States Patent
Lin

(10) Patent No.: US 8,424,928 B2
(45) Date of Patent: Apr. 23, 2013

(54) DOOR HANDLE HAVING A HANDGRIP CHANGEABLE INDOOR AND OUTDOOR

(75) Inventor: Ching Tien Lin, Taipei Hsien (TW)

(73) Assignee: Thase Enterprise Co., Ltd., Sinjhuang, Taipei Hsien (TW)

( * ) Notice: Subject to any disclaimer, the term of this patent is extended or adjusted under 35 U.S.C. 154(b) by 242 days.

(21) Appl. No.: 12/924,333

(22) Filed: Sep. 24, 2010

(65) Prior Publication Data

US 2012/0073084 A1 Mar. 29, 2012

(51) Int. Cl.
*E05B 65/10* (2006.01)
*E05B 3/00* (2006.01)

(52) U.S. Cl.
USPC ..... 292/92; 292/336.3; 70/92; 70/224

(58) Field of Classification Search ..... 292/90–94, 292/336.3; 70/92, 224
See application file for complete search history.

(56) References Cited

U.S. PATENT DOCUMENTS

| | | | | | |
|---|---|---|---|---|---|
| 1,025,102 | A * | 4/1912 | Voight | 292/92 |
| 2,198,359 | A * | 4/1940 | Edwards et al. | 70/92 |
| 2,910,858 | A * | 11/1959 | Jackson | 70/92 |
| 3,266,829 | A * | 8/1966 | Yoe et al. | 292/92 |
| 3,869,159 | A * | 3/1975 | Eads | 292/92 |
| 3,897,092 | A * | 7/1975 | Atkins | 292/92 |
| 3,981,164 | A * | 9/1976 | Balducci | 70/92 |
| 4,387,917 | A * | 6/1983 | Cocker | 292/40 |
| 4,986,583 | A * | 1/1991 | Campbell et al. | 292/336.3 |
| 5,165,739 | A | 11/1992 | Liu | |
| 5,403,047 | A * | 4/1995 | Walls | 292/173 |
| 5,730,478 | A * | 3/1998 | D'Hooge | 292/348 |
| 6,196,599 | B1 * | 3/2001 | D'Hooge | 292/165 |
| 6,293,598 | B1 * | 9/2001 | Rusiana | 292/143 |
| 7,181,940 | B2 | 2/2007 | Lin | |
| 7,258,374 | B2 * | 8/2007 | Rusiana | 292/336.3 |
| 7,455,333 | B2 * | 11/2008 | Ookawara | 292/34 |
| 2010/0018268 | A1 * | 1/2010 | Parker | 70/489 |

FOREIGN PATENT DOCUMENTS

FR 2609492 A1 * 7/1988

* cited by examiner

*Primary Examiner* — Carlos Lugo
(74) *Attorney, Agent, or Firm* — Charles E. Baxley

(57) ABSTRACT

A door handle assembly includes a lock casing having an inner cam and an outer cam and a latch bolt, an indoor handle device attached to an inner portion of the lock casing with an actuating device and having a handgrip for being depressed to actuate an actuating bolt and the inner cam to operate the latch bolt, and an outdoor handle device attached to an outer portion of the lock casing with another actuating device and having another handgrip for being pulled to actuate another actuating bolt and the outer cam to operate the latch bolt, the outdoor handle device and indoor handle device are replaceable with each other when the actuating devices are disposed up-side-down.

2 Claims, 9 Drawing Sheets

DOOR HANDLE HAVING A HANDGRIP CHANGEABLE INDOOR AND OUTDOOR

BACKGROUND OF THE INVENTION

1. Field of the Invention

The present invention relates to a door handle assembly, and more particularly to a handle assembly for attaching to a door panel and for actuating or operating a door latch and including a handgrip attachable either to the inside or to the outside of the door panel for allowing the handle assembly to be easily manufactured and to be easily and quickly attached or mounted to the door panel and for allowing the handgrip to be easily and quickly replaced with the new ones.

2. Description of the Prior Art

Typical door panel assemblies comprise an indoor handgrip and an outdoor handgrip attached or mounted to the inside and the outside of the door panel respectively for actuating or operating a door latch of the door panel and for selectively opening or closing the door panel.

For example, U.S. Pat. No. 5,165,739 to Liu discloses one of the typical door latches comprising a spindle engaged through the door panel, and an indoor handgrip or knob and an outdoor handgrip or knob attached or mounted to the spindle for actuating or operating a latch bolt relative to the door panel to selectively open or close the door panel.

However, the indoor handgrip or knob and the outdoor handgrip or knob include the predetermined structure that may only be attached or mounted to the inside and the outside of the door panel respectively, but may not be attached or mounted to the other or opposite side of the door panel such that the indoor handgrip or knob and the outdoor handgrip or knob may not be changed or replaced with the other ones.

U.S. Pat. No. 7,181,940 to Lin discloses another typical door lock transmission mechanism also comprising an indoor handgrip or knob and an outdoor handgrip or knob attached or mounted to the inside and the outside of the door panel for actuating or operating a latch bolt relative to the door panel to selectively open or close the door panel.

However, the indoor handgrip or knob and the outdoor handgrip or knob also include the predetermined structure that may only be attached or mounted to the inside and the outside of the door panel respectively, but may not be attached or mounted to the other or opposite side of the door panel such that the indoor handgrip or knob and the outdoor handgrip or knob may not be changed or replaced with the other ones.

The present invention has arisen to mitigate and/or obviate the afore-described disadvantages of the conventional door handle assemblies.

SUMMARY OF THE INVENTION

The primary objective of the present invention is to provide a door handle assembly including a handgrip attachable either to the inside or to the outside of the door panel for allowing the handle assembly to be easily manufactured and to be easily and quickly attached or mounted to the door panel and for allowing the handgrip to be easily and quickly replaced with the new ones.

In accordance with one aspect of the invention, there is provided a door handle assembly comprising a lock casing including an inner cam and an outer cam, and including an inner portion and an outer portion, and including a latch bolt selectively actuatable by either the inner cam or the outer cam, an indoor handle device including a first housing attached to the inner portion of the lock casing, and including a first handgrip having an inner portion pivotally attached to the first housing and having an actuating tongue extended from the inner portion of the first handgrip, and the first handgrip including an outer portion extended out of the first housing, a first actuating device including a first receptacle attached to the first housing, and including a chamber formed in the first receptacle, and including a first rotary member rotatably engaged in the chamber of the first receptacle and having an eccentric pin, and including a first sliding member engaged in the chamber of the first receptacle and having an actuating end engageable with the actuating tongue of the first handgrip, and including a spring biasing member for biasing the actuating end of the first sliding member to engage with the actuating tongue of the first handgrip, the first sliding member including an engaging member for engaging with the eccentric pin of the first rotary member and for rotating the first rotary member when the first sliding member is moved relative to the first receptacle, and a first actuating bolt attached to the first rotary member and rotated in concert with the first rotary member and engaged with the inner cam for allowing the first sliding member to be moved by the first handgrip of the indoor handle device when the first handgrip is moved toward the lock casing, in order to rotate the first rotary member and the first actuating bolt and the inner cam to actuate the latch bolt relative to the lock casing, an outdoor handle device including a second housing attached to the outer portion of the lock casing, and including a second handgrip having an inner portion pivotally attached to the second housing and having an actuating tongue extended from the inner portion of the second handgrip, and the second handgrip including an outer portion extended out of the second housing, and a second actuating device including a second receptacle attached to the second housing, and including a chamber formed in the second receptacle, and including a second rotary member rotatably engaged in the chamber of the second receptacle and having an eccentric pin, and including a second sliding member engaged in the chamber of the second receptacle and having an actuating end engageable with the actuating tongue of the second handgrip, and including a spring biasing member for biasing the actuating end of the second sliding member to engage with the actuating tongue of the second handgrip, the second sliding member including an engaging member for engaging with the eccentric pin of the second rotary member and for rotating the second rotary member when the second sliding member is moved relative to the second receptacle, and a second actuating bolt attached to the second rotary member and rotated in concert with the second rotary member and engaged with the outer cam for allowing the second sliding member to be moved by the second handgrip of the outdoor handle device when the second handgrip is moved away from the lock casing, in order to rotate the second rotary member and the second actuating bolt and the outer cam to actuate the latch bolt relative to the lock casing, and the outdoor handle device being attachable to the inner portion of the lock casing with the first actuating device when the first actuating device is disposed up-side-down, the indoor handle device being attachable to the outer portion of the lock casing with the second actuating device when the second actuating device is disposed up-side-down, the first and the second actuating devices include the identical structure that may be easily and quickly manufactured and assembled in mass production, and that may be easily and quickly replaced with each other.

The lock casing includes at least one orifice formed in the inner portion thereof, and the first receptacle includes at least one peg engaged into the orifice of the lock casing for anchoring or retaining the first receptacle and the first housing to the lock casing and for preventing the first receptacle and the first housing from being rotated relative to the lock casing.

The first receptacle includes a passage formed therein for slidably receiving the actuating end of the first sliding member. The first receptacle includes a cover having a hole formed in the cover for engaging with the first actuating bolt. The first receptacle includes a bore formed therein for rotatably receiving and engaging with the first rotary member.

The lock casing includes at least one aperture formed in the outer portion thereof, and the second receptacle includes at least one peg engaged into the aperture of the lock casing for anchoring or retaining the second receptacle and the second housing to the lock casing and for preventing the second receptacle and the second housing from being rotated relative to the lock casing.

The second receptacle includes a passage formed therein for slidably receiving the actuating end of the second sliding member. The second receptacle includes a cover having a hole formed in the cover for engaging with the second actuating bolt. The second receptacle includes a bore formed therein for rotatably receiving and engaging with the second rotary member.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
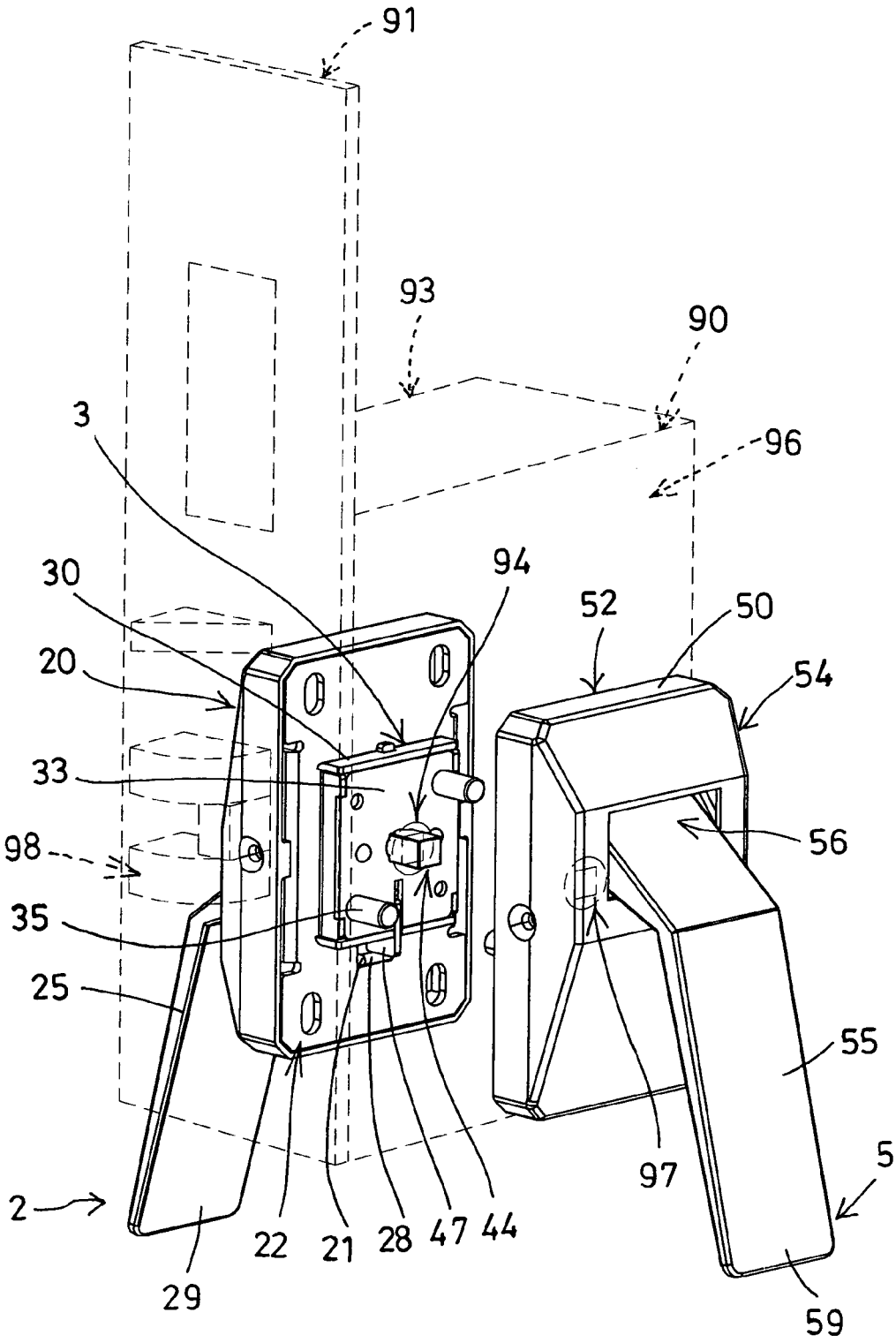
FIG. 1 is a partial perspective view of a door handle assembly in accordance with the present invention.
Figure 2:
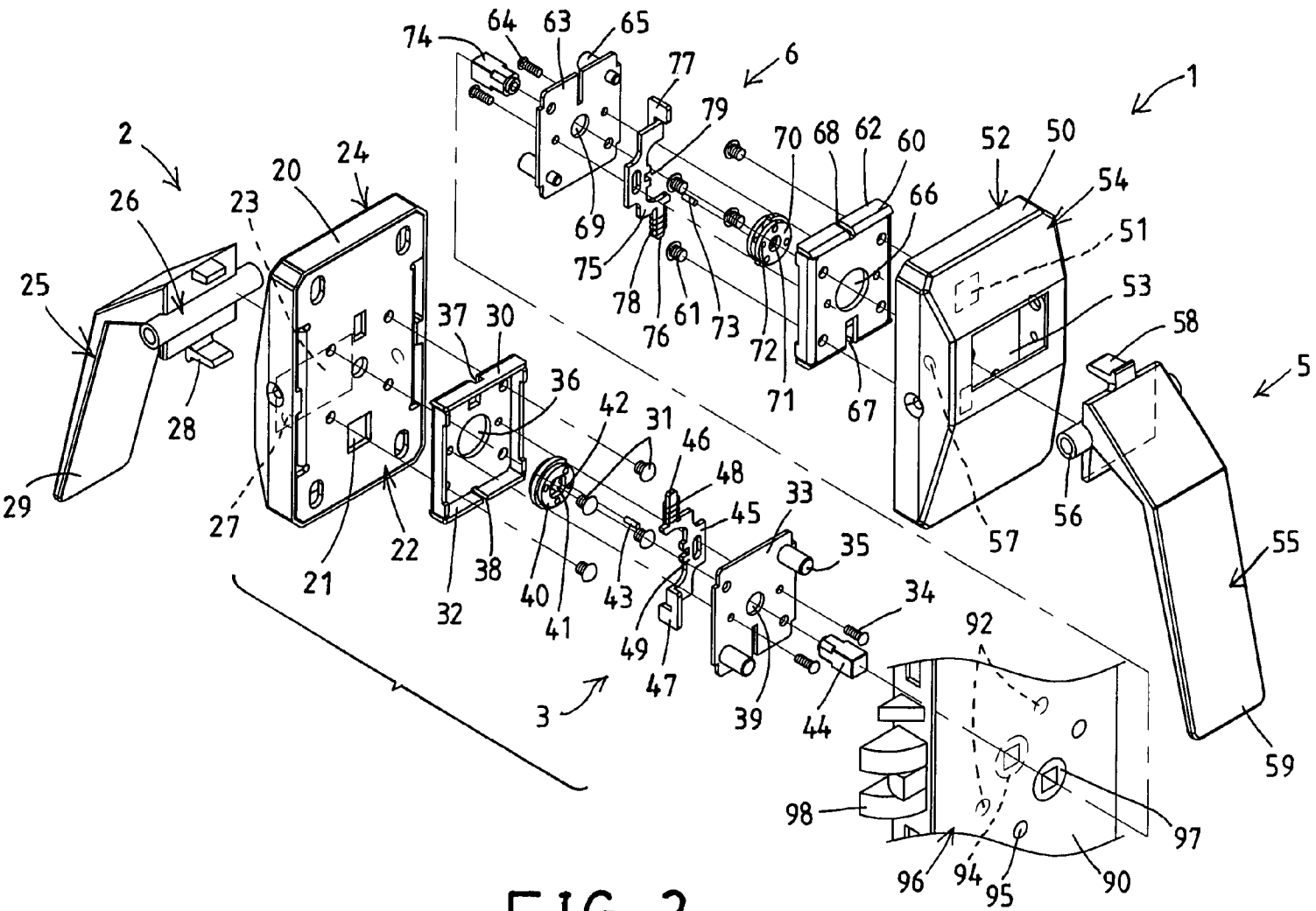
FIG. 2 is a partial exploded view of the door handle assembly.
Figure 3:
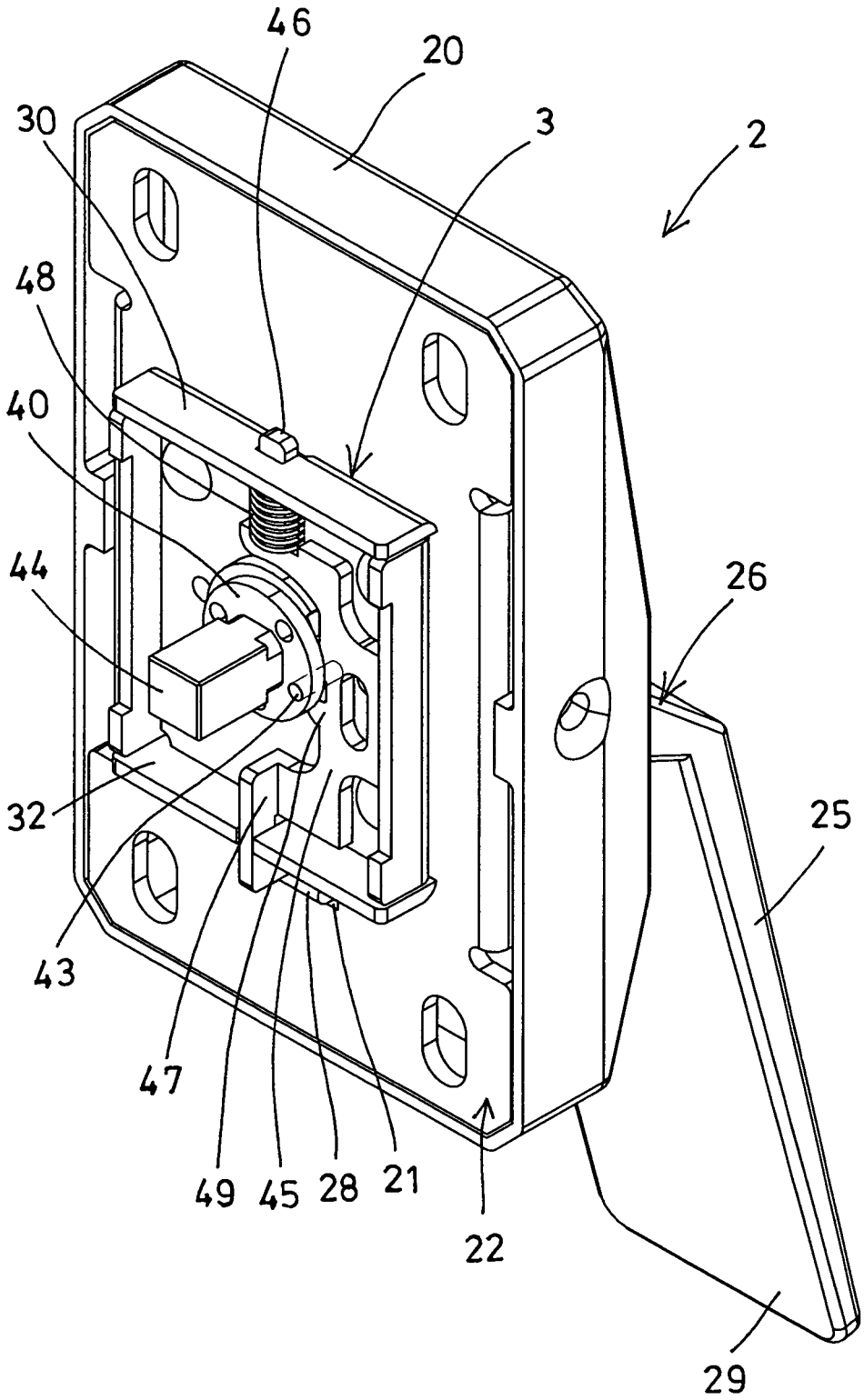
FIG. 3 is a perspective view of an indoor handle of the door handle assembly.
Figure 4:
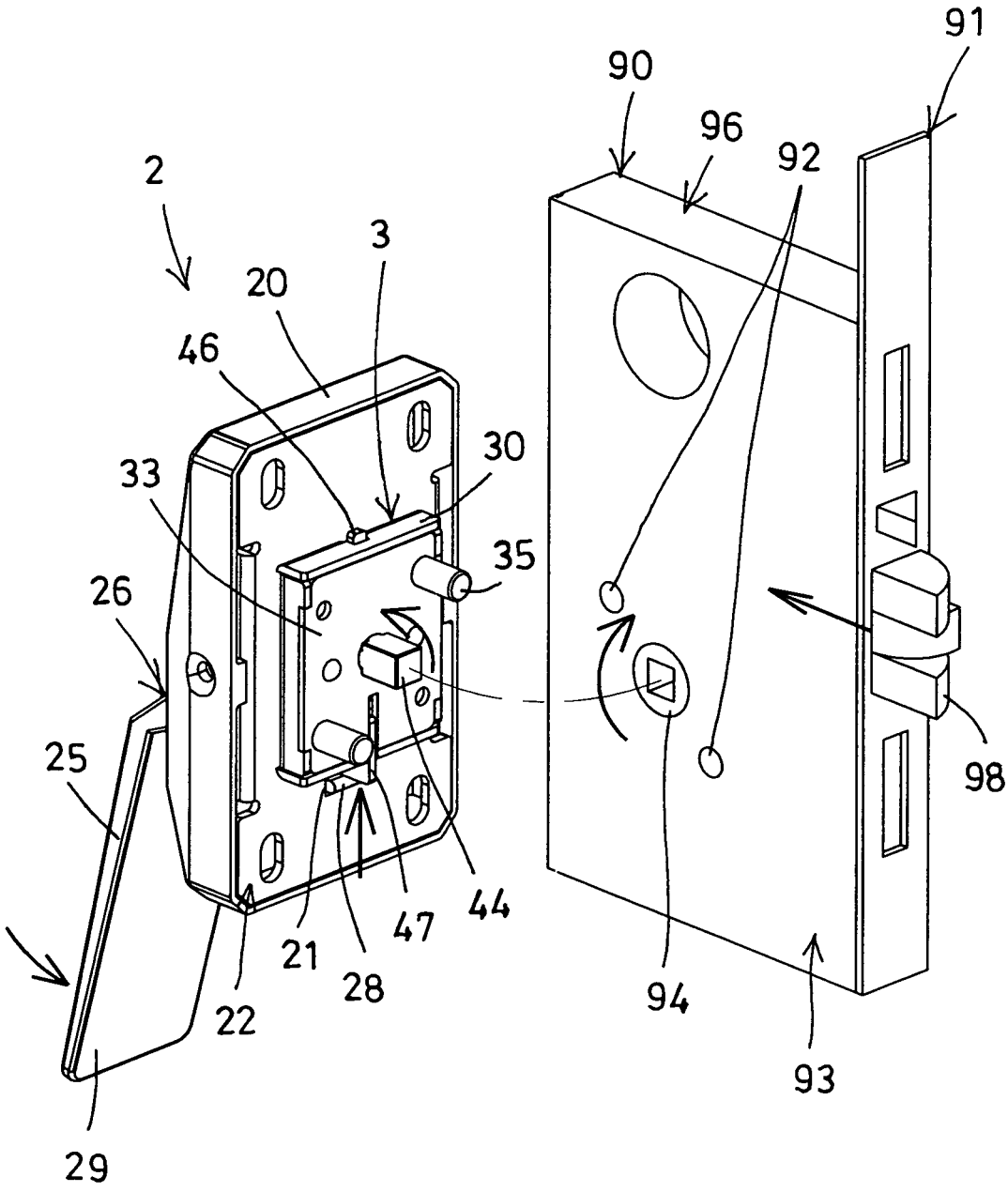
FIG. 4 is a partial exploded view illustrating the operation of the indoor handle of the door handle assembly.
Figure 5:
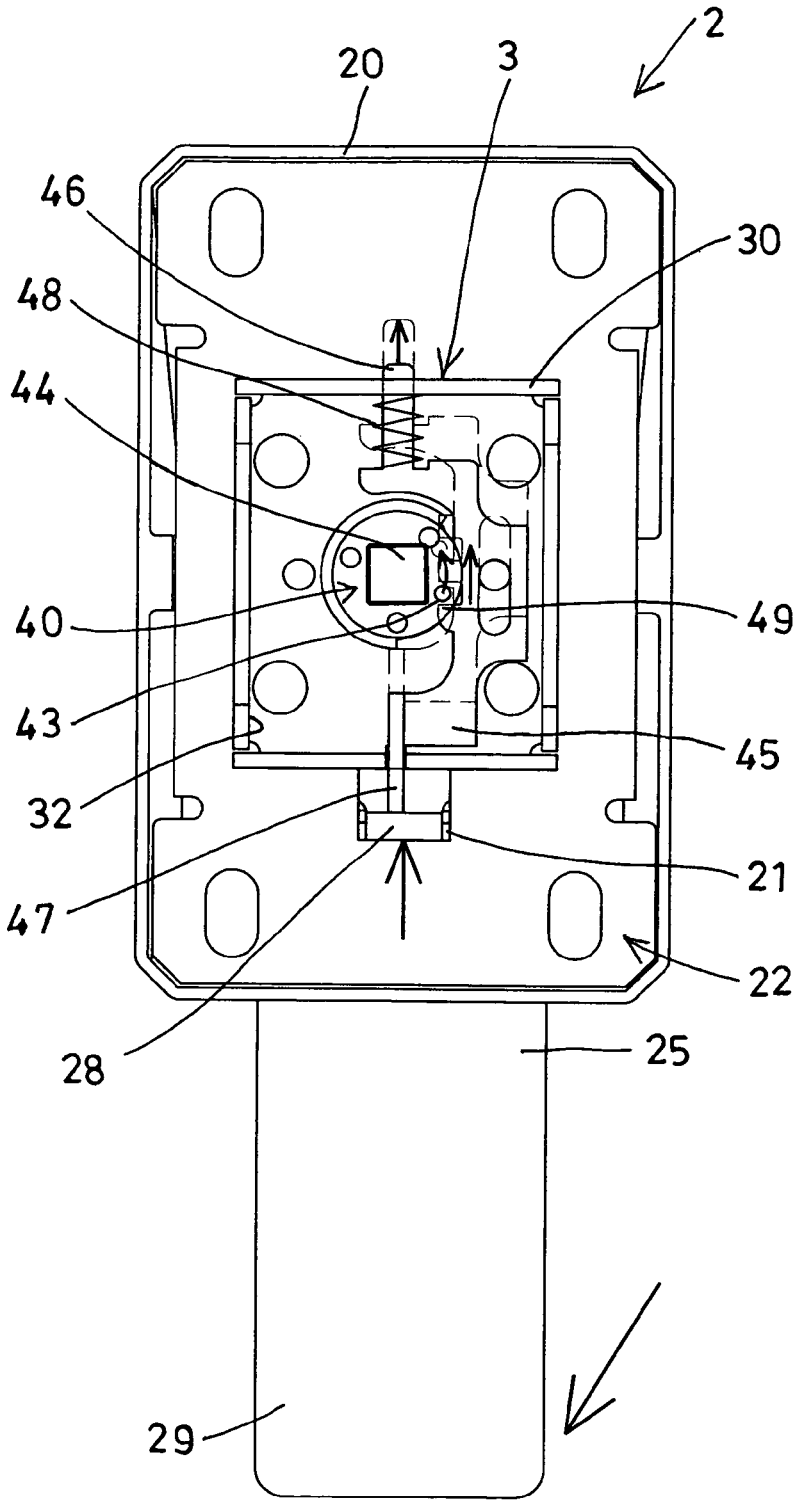
FIG. 5 is a plan schematic view of the indoor handle of the door handle assembly.
Figure 6:
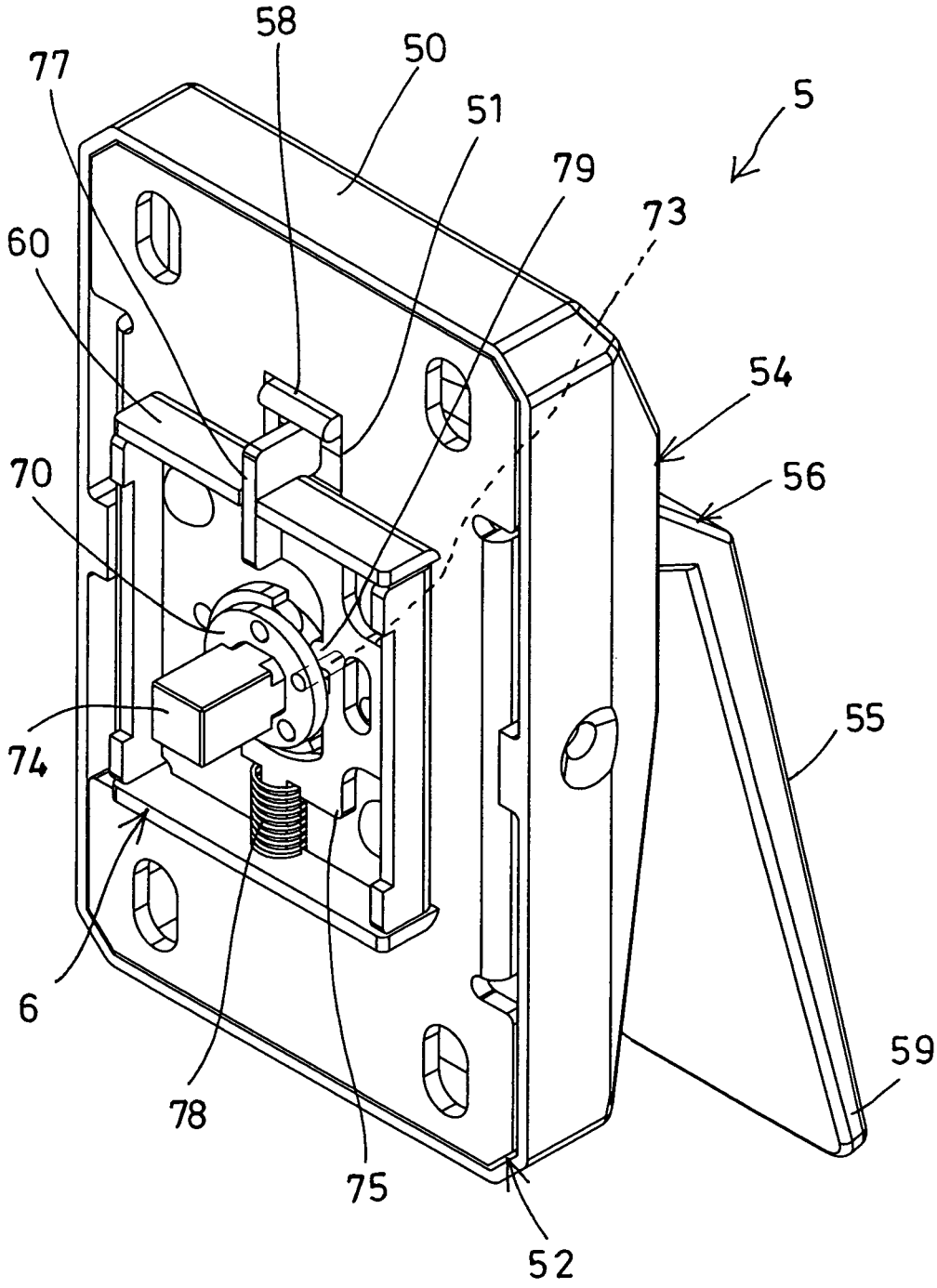
FIG. 6 is a perspective view of an outdoor handle of the door handle assembly.
Figure 7:
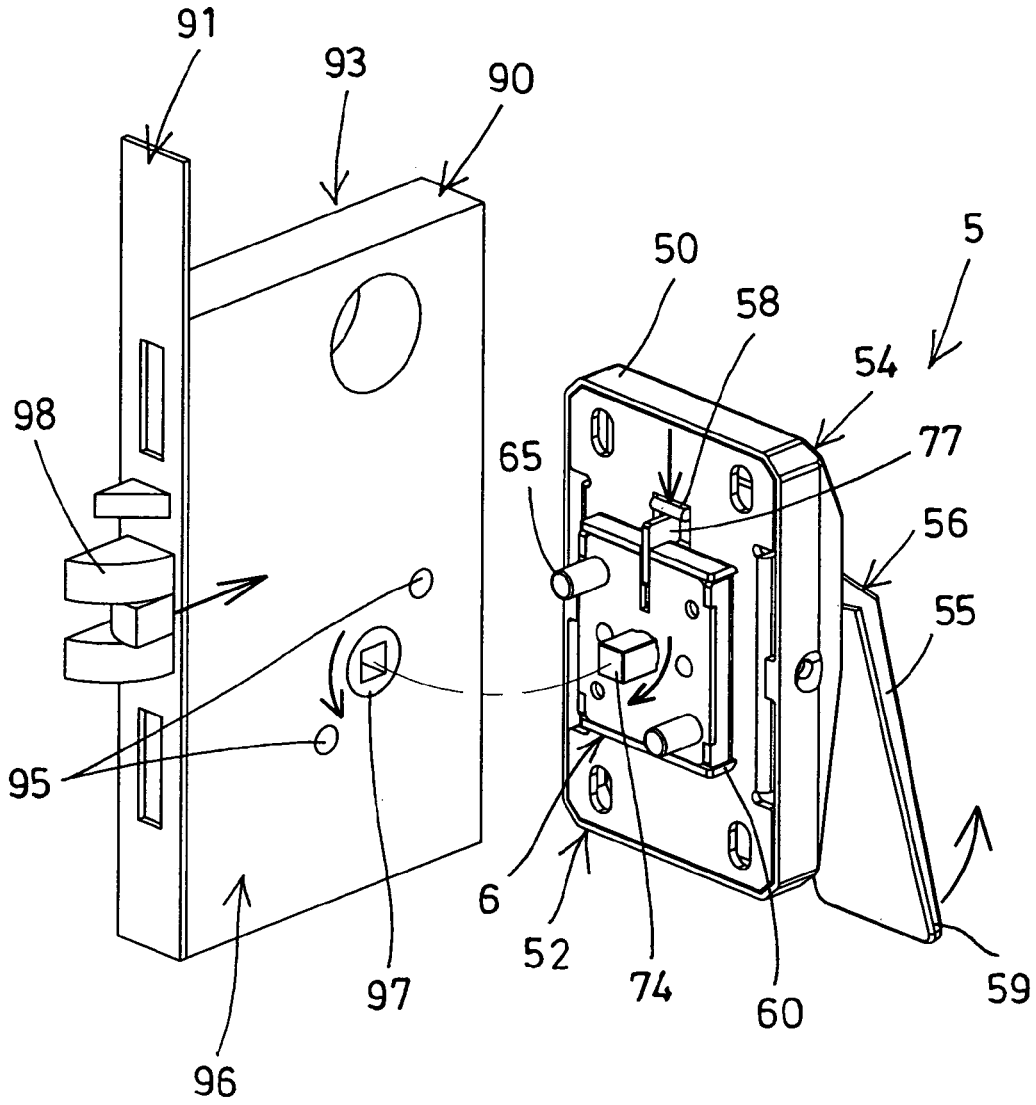
FIG. 7 is a partial exploded view illustrating the operation of the outdoor handle of the door handle assembly.
Figure 8:
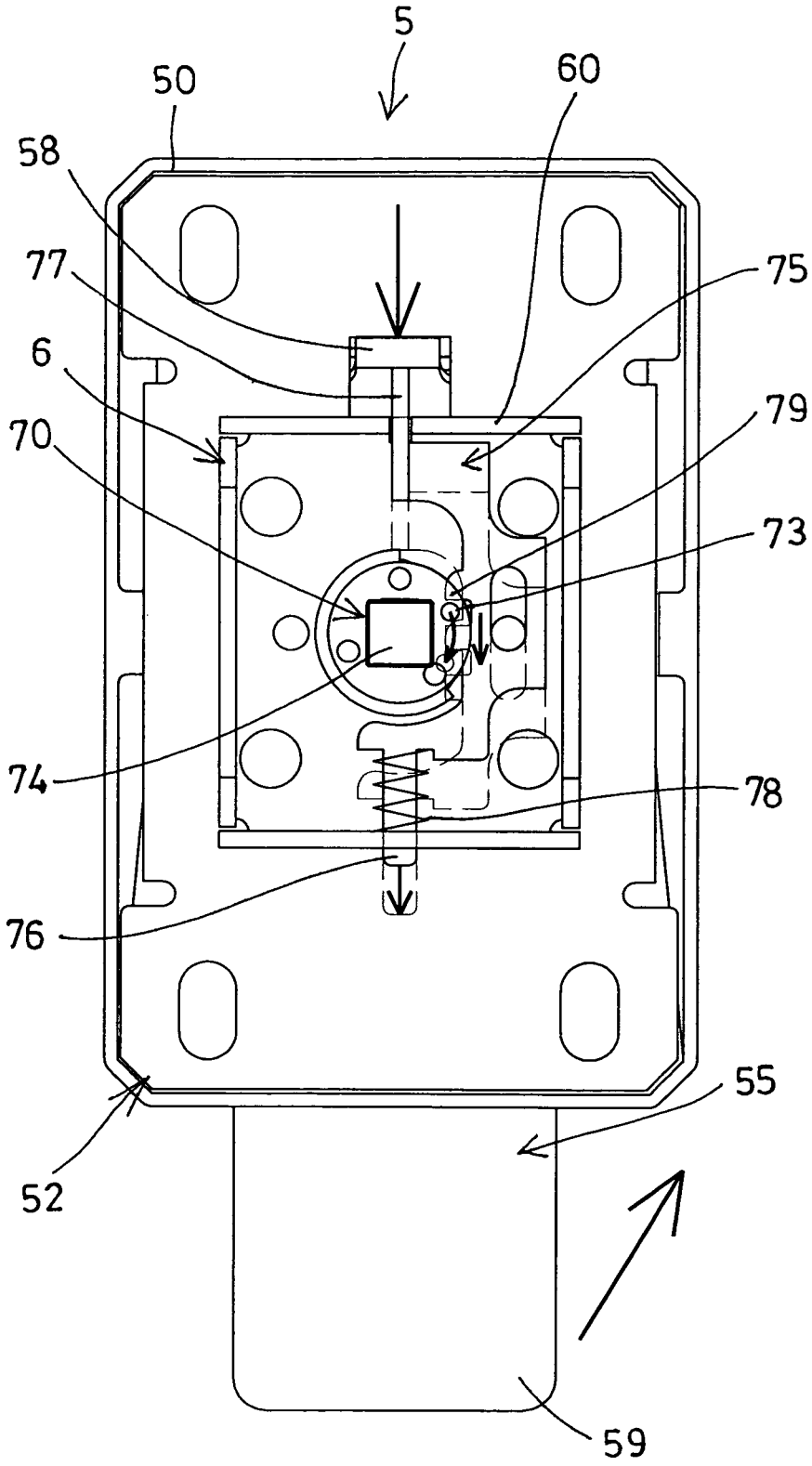
FIG. 8 is a plan schematic view of the outdoor handle of the door handle assembly.

Referring to the drawings, and initially to FIGS. 1 and 2, a door lock in accordance with the present invention comprises a lock casing 90 for attaching or mounting or securing to or in a door panel (which is represented by) 91 or the like, the lock casing 90 includes one or more (such as two) orifices 92 formed in one side or inner portion 93 thereof (FIG. 4), an inner cam 94 pivotally or rotatably attached or mounted to the inner portion 93 of the lock casing 90 and disposed or located between the orifices 92 of the lock casing 90, one or more (such as two) apertures 95 formed in the other side or outer portion 96 of the lock casing 90 (FIG. 7), and an outer cam 97 pivotally or rotatably attached or mounted to the outer portion 96 of the lock casing 90 and disposed or located between the apertures 95 of the lock casing 90.

The lock casing 90 further includes a latch bolt 98 slidably received or engaged in the lock casing 90 and/or the door panel 91 and retractable into or extendible out of the door panel 91, and coupled to the inner cam 94 and the outer cam 97 for allowing the latch bolt 98 to be selectively actuated or driven by either the inner cam 94 or the outer cam 97 and to be selectively retracted into the door panel 91 by either the inner cam 94 or the outer cam 97. The coupling or the configuration of the inner cam 94 and the outer cam 97 and the latch bolt 98 is not related to the present invention and will not be described in further details. The present invention is to provide a handle assembly 1 comprising an indoor handle device 2 and an outdoor handle device 5 attached or mounted to the lock casing 90 and/or the door panel 91 for selectively actuating or operating the inner cam 94 and the outer cam 97 to move the latch bolt 98.

The indoor handle device 2 includes a housing 20 attached or mounted or secured to the door panel 91, the housing 20 includes a perforation 21 formed in the inner portion 22 thereof and facing or directing toward the lock casing 90 and the door panel 91, and includes an opening 23 formed in the outer portion 24 thereof, a handgrip 25 includes one end or inner portion 26 disposed or engaged into the housing 20 and pivotally or rotatably attached or mounted or secured or coupled to the housing 20 with a pivot axle 27, and includes an actuating tongue 28 extended from the inner portion 26 of the handgrip 25 and extended into or through the perforation 21 of the housing 20 (FIGS. 1, 3-5), and includes an outer portion 29 extended out through the opening 23 of the housing 20.

An actuating device 3 includes a receptacle 30 attached or mounted or secured to the inner portion 22 of the housing 20 with latches or fasteners 31 or the like, and includes a chamber 32 formed in the receptacle 30, and includes a cover 33 attached or mounted or secured to the inner portion of the receptacle 30 with latches or fasteners 34 or the like, and includes one or more (such as two) pegs 35 extended from the cover 33 or the receptacle 30 and engaged into the orifices 92 of the lock casing 90 for anchoring or securing or retaining the receptacle 30 and the housing 20 to the lock casing 90 and the door panel 91, and includes a bore 36 formed in the receptacle 30 for pivotally or rotatably receiving or engaging with or retaining a rotary member 40, and includes an upper slot 37 and a lower passage 38 formed in the receptacle 30, and includes a hole 39 formed in the cover 33.

The rotary member 40 is received or engaged in the chamber 32 of the receptacle 30 and includes a bore 41 formed therein, such as formed in the center portion thereof, and includes one or more orifices 42 formed therein, such as formed and located around the bore 41 of the rotary member 40 for selectively engaging with an eccentric pin 43 which is attached or mounted to the rotary member 40 and offset from the center bore 41 of the rotary member 40. A sliding member 45 is slidably received or engaged in the chamber 32 of the receptacle 30, and includes an upper end 46 and a lower actuating end 47 slidably engaged in the slot 37 and the passage 38 of the receptacle 30 respectively, in which the actuating end 47 is engageable with the actuating tongue 28 of the handgrip 25 (FIGS. 1 and 3-5), and a spring biasing member 48 is engaged onto the upper end 46 of the sliding member 45 and engaged between the sliding member 45 and the receptacle 30 for biasing or forcing the actuating end 47 of the sliding member 45 to engage with the actuating tongue 28 of the handgrip 25. The fasteners 34 may be slidably engaged with the sliding member 45 for guiding or limiting the sliding member 45 to move or slide relative to the receptacle 30.

The sliding member 45 further includes a holder or anchoring or engaging member 49 for engaging with the pin 43 or the rotary member 40 and for pivoting or rotating the rotary member 40 when the sliding member 45 is slid or moved up and down relative to the receptacle 30, and an actuating bolt 44 is engaged through the hole 39 of the cover 33 and engaged with or attached or mounted or secured to the bore 41 of the rotary member 40 and rotated in concert with the rotary member 40, the actuating bolt 44 is also engaged with the inner cam 94 such that the sliding member 45 may be actuated or moved by the handgrip 25 of the indoor handle device 2 when the handgrip 25 is depressed or moved toward the lock casing 90 or the door panel 91 (FIGS. 4, 5), in order to pivot or rotate the rotary member 40 and to pivot or rotate the actuating bolt 44 and the inner cam 94 and to selectively retract or move the latch bolt 98 relative to or into the door panel 91.

Referring next to FIGS. 1-2 and 6-8, the outdoor handle device 5 includes a housing 50 attached or mounted or secured to the door panel 91, the housing 50 includes a perforation 51 formed in the inner portion 52 thereof and facing or directing toward the lock casing 90 and the door panel 91, and includes an opening 53 formed in the outer portion 54 thereof, a handgrip 55 includes one end or inner portion 56 disposed or engaged into the housing 50 and pivotally or rotatably attached or mounted or secured or coupled to the housing 50 with a pivot axle 57, and includes an actuating tongue 58 extended from the inner portion 56 of the handgrip 55 and extended into or through the perforation 51 of the housing 50 (FIGS. 6-8), and includes an outer portion 59 extended out through the opening 53 of the housing 50.

An actuating device 6 includes a receptacle 60 attached or mounted or secured to the inner portion 52 of the housing 50 with latches or fasteners 61 or the like, and includes a chamber 62 formed in the receptacle 60, and includes a cover 63 attached or mounted or secured to the inner portion of the receptacle 60 with latches or fasteners 64 or the like, and includes one or more (such as two) pegs 65 extended from the cover 63 and engaged into the apertures 95 of the lock casing 90 for anchoring or securing or retaining the receptacle 60 and the housing 50 to the lock casing 90 and the door panel 91, and includes a bore 66 formed in the receptacle 60 for pivotally or rotatably receiving or engaging with or retaining a rotary member 70, and includes a lower slot 67 and an upper passage 68 formed in the receptacle 60, and includes a hole 69 formed in the cover 63.

The rotary member 70 includes a bore 71 formed therein, such as formed in the center portion thereof, and includes one or more orifices 72 formed therein, such as formed and located around the bore 71 of the rotary member 70 for selectively engaging with an eccentric pin 73 which is attached or mounted to the rotary member 60 and offset from the center bore 71 of the rotary member 70. A sliding member 75 is slidably received or engaged in the chamber 62 of the receptacle 60, and includes a lower end 76 and an upper actuating end 77 slidably engaged in the slot 67 and the passage 68 of the receptacle 60 respectively, in which the actuating end 77 is engageable with the actuating tongue 58 of the handgrip 55 (FIGS. 6-8), and a spring biasing member 78 is engaged onto the lower end 76 of the sliding member 75 and engaged between the sliding member 75 and the receptacle 60 for biasing or forcing the actuating end 77 of the sliding member 75 to engage with the actuating tongue 58 of the handgrip 55. The fasteners 64 may be slidably engaged with the sliding member 75 for guiding or limiting the sliding member 75 to move or slide relative to the receptacle 60.

The sliding member 75 further includes a holder or anchoring or engaging member 79 for engaging with the pin 73 or the rotary member 70 and for pivoting or rotating the rotary member 70 when the sliding member 75 is slid or moved up and down relative to the receptacle 60, and an actuating bolt 74 is engaged through the hole 69 of the cover 63 and engaged with or attached or mounted or secured to the bore 71 of the rotary member 70 and rotated in concert with the rotary member 70, the actuating bolt 74 is also engaged with the outer cam 97 such that the sliding member 75 may be actuated or moved by the handgrip 55 of the outdoor handle device 5 when the handgrip 55 is pulled or moved away from the lock casing 90 or the door panel 91 (FIGS. 7, 8), in order to pivot or rotate the rotary member 70 and to pivot or rotate the actuating bolt 74 and the outer cam 97 and to selectively retract or more the latch bolt 98 into the door panel 91.

In operation, as shown in FIGS. 1-2, and 4-7, the housing 20 and the handgrip 25 of the indoor handle device 2 and the housing 50 and the handgrip 55 of the outdoor handle device 5 may be attached or mounted or secured to the inner portion 93 and the outer portion 96 of the lock casing 90 respectively, and may be coupled to the inner cam 94 and the outer cam 97 with the actuating devices 3, 6 respectively for allowing the latch bolt 98 to be selectively actuated or driven by either the inner cam 94 or the outer cam 97 and to be selectively retracted into the door panel 91 by either the inner cam 94 or the outer cam 97 and by either the handgrip 25 of the indoor handle device 2 or the handgrip 55 of the outdoor handle device 5.

Figure 9:
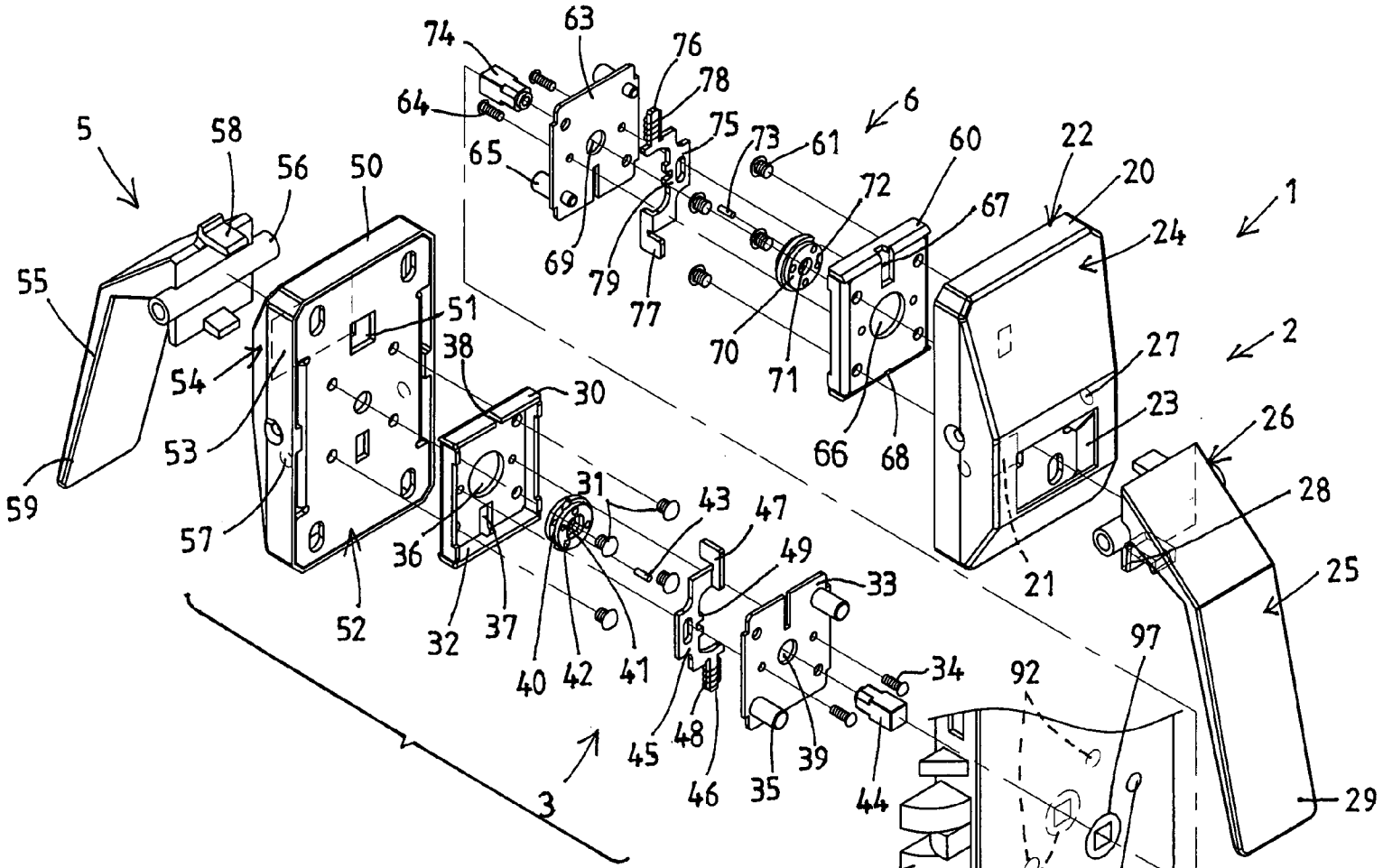
FIG. 9 is a partial exploded view similar to FIG. 2, illustrating the other arrangement of the door handle assembly.

As shown in FIG. 9, when the housing 20 and the handgrip 25 of the indoor handle device 2 and the housing 50 and the handgrip 55 of the outdoor handle device 5 are attached or mounted or secured to the outer portion 96 and the inner portion 93 of the lock casing 90 respectively, the actuating devices 3, 6 may be disposed up-side-down for coupling the handgrip 25 of the indoor handle device 2 and the handgrip 55 of the outdoor handle device 5 to the outer cam 97 and the inner cam 94 respectively, for allowing the latch bolt 98 to be selectively actuated or driven by either the inner cam 94 or the outer cam 97 and to be selectively retracted into the door panel 91 by either the inner cam 94 or the outer cam 97 and by either the handgrip 25 of the indoor handle device 2 or the handgrip 55 of the outdoor handle device 5.

It is to be noted that the actuating devices 3, 6 include the identical structure that may be easily and quickly manufactured and assembled in mass production, and the housing 20 and the handgrip 25 of the indoor handle device 2 and the housing 50 and the handgrip 55 of the outdoor handle device 5 include almost the same configuration except that the perforations 21, 51 and the actuating tongues 28, 58 of the housings 20, 50 are different from each other, the structure or the configuration of the indoor handle device 2 and the outdoor handle device 5 allows the handgrip 25 of the indoor handle device 2 and the handgrip 55 of the outdoor handle device 5 to be changed with each other and to be easily and quickly replaced with the new ones and to be selectively attached or mounted or secured to the outer portion 96 or the inner portion 93 of the lock casing 90 respectively.

Accordingly, the door handle assembly in accordance with the present invention includes a handgrip attachable either to the inside or to the outside of the door panel for allowing the handle assembly to be easily manufactured and to be easily and quickly attached or mounted to the door panel and for allowing the handgrip to be easily and quickly replaced with the new ones.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door handle assembly comprising:

a lock casing including an inner cam and an outer cam, and including an inner portion and an outer portion, and including a latch bolt selectively actuatable by either said inner cam or said outer cam, an indoor handle device including a first housing attached to said inner portion of said lock casing, and including a first handgrip having an inner portion pivotally attached to said first housing and having an actuating tongue extended from said inner portion of said first handgrip, and said first handgrip including an outer portion extended out of said first housing, a first actuating device including a first receptacle attached to said first housing, and including a chamber formed in said first receptacle, and including a first rotary member rotatably engaged in said chamber of said first receptacle and having an eccentric pin, and including a first sliding member engaged in said chamber of said first receptacle and having an actuating end engageable with said actuating tongue of said first handgrip, and including a spring biasing member for biasing said actuating end of said first sliding member to engage with said actuating tongue of said first handgrip, said first sliding member including an engaging member for engaging with said eccentric pin of said first rotary member and for rotating said first rotary member when said first sliding member is moved relative to said first receptacle, and a first actuating bolt attached to said first rotary member and rotated in concert with said first rotary member and engaged with said inner cam for allowing said first sliding member to be moved by said first handgrip of said indoor handle device when said first handgrip is moved toward said lock casing, in order to rotate said first rotary member and said first actuating bolt and said inner cam to actuate said latch bolt relative to said lock casing, said first receptacle including a passage formed therein for slidably receiving said actuating end of said first sliding member, and including a cover having a hole formed in said cover for engaging with said first actuating bolt, and including a bore formed in said first receptacle for rotatably receiving and engaging with said first rotary member, an outdoor handle device including a second housing attached to said outer portion of said lock casing, and including a second handgrip having an inner portion pivotally attached to said second housing and having an actuating tongue extended from said inner portion of said second handgrip, and said second handgrip including an outer portion extended out of said second housing, and a second actuating device including a second receptacle attached to said second housing, and including a chamber formed in said second receptacle, and including a second rotary member rotatably engaged in said chamber of said second receptacle and having an eccentric pin, and including a second sliding member engaged in said chamber of said second receptacle and having an actuating end engageable with said actuating tongue of said second handgrip, and including a spring biasing member for biasing said actuating end of said second sliding member to engage with said actuating tongue of said second handgrip, said second sliding member including an engaging member for engaging with said eccentric pin of said second rotary member and for rotating said second rotary member when said second sliding member is moved relative to said second receptacle, and a second actuating bolt attached to said second rotary member and rotated in concert with said second rotary member and engaged with said outer cam for allowing said second sliding member to be moved by said second handgrip of said outdoor handle device when said second handgrip is moved away from said lock casing, in order to rotate said second rotary member and said second actuating bolt and said outer cam to actuate said latch bolt relative to said lock casing, and said second receptacle including a passage formed therein for slidably receiving said actuating end of said second sliding member, and including a cover having a hole formed in said cover for engaging with said second actuating bolt, and including a bore formed in said second receptacle for rotatably receiving and engaging with said second rotary member, and said outdoor handle device being attachable to said inner portion of said lock casing with said first actuating device when said first actuating device is disposed up-side-down, said indoor handle device being attachable to said outer portion of said lock casing with said second actuating device when said second actuating device is disposed up-side-down.

2. The door handle assembly as claimed in claim 1, wherein said lock casing includes at least one aperture formed in said outer portion thereof, and said second receptacle includes at least one peg engaged into said at least one aperture of said lock casing for anchoring said second receptacle and said second housing to said lock casing.

* * * * *